US009508296B2

(12) United States Patent
Guo et al.

(10) Patent No.: US 9,508,296 B2
(45) Date of Patent: Nov. 29, 2016

(54) DRIVING METHOD OF PIXEL ARRAY, DRIVING MODULE OF PIXEL ARRAY AND DISPLAY DEVICE

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Renwei Guo, Beijing (CN); Xue Dong, Beijing (CN); Shengji Yang, Beijing (CN); Peng Liu, Beijing (CN)

(73) Assignees: BOE TECHNOLOGY GROUP CO., LTD., Beijing (CN); BEIJING BOE OPTOELECTRONICS TECHNOLOGY CO., LTD, Beijing (CN)

( * ) Notice: Subject to any disclaimer, the term of this patent is extended or adjusted under 35 U.S.C. 154(b) by 58 days.

(21) Appl. No.: 14/573,667

(22) Filed: Dec. 17, 2014

(65) Prior Publication Data

US 2016/0055808 A1 Feb. 25, 2016

(30) Foreign Application Priority Data

Aug. 25, 2014 (CN) ..... 2014 1 0421952

(51) Int. Cl.
*G09G 3/32* (2016.01)
*G09G 3/36* (2006.01)

(52) U.S. Cl.
CPC ..... *G09G 3/3607* (2013.01); *G09G 3/3208* (2013.01); *G09G 3/3614* (2013.01); *G09G 2300/0452* (2013.01); *G09G 2320/0209* (2013.01); *G09G 2340/0457* (2013.01)

(58) Field of Classification Search
CPC .. G09G 3/20; G09G 3/2003; G09G 2310/08; G09G 2320/0242; G09G 2300/0452; G09G 2320/0633; G09G 2320/0626; G09G 2320/064; G09G 2320/0646; G09G 2320/0653; G09G 2320/0233; G09G 3/3208; G09G 3/3607; G09G 3/3614; G09G 2340/0457; G09G 2320/0209
USPC ..... 345/694
See application file for complete search history.

(56) References Cited

U.S. PATENT DOCUMENTS

2007/0064020 A1* 3/2007 Credelle ..... G09G 3/2003 345/694
2007/0070086 A1* 3/2007 Brown Elliott ..... G09G 5/02 345/613
2008/0292207 A1* 11/2008 Kang ..... G06T 5/008 382/274

(Continued)

FOREIGN PATENT DOCUMENTS

CN 101231402 A 7/2008
CN 102568417 A 7/2012

(Continued)

OTHER PUBLICATIONS

Office Action dated Dec. 28, 2015 issued in corresponding Chinese Application No. 201410421952.0.

*Primary Examiner* — Andrew Sasinowski
*Assistant Examiner* — Chineyere Wills-Burns
(74) *Attorney, Agent, or Firm* — Nath Goldberg and Meyer; Joshua B. Goldberg; Christopher Thomas

(57) ABSTRACT

The present invention provides a driving method of a pixel array, wherein the driving method includes: step 1, obtaining a theoretical brightness value of each sub-pixel for an image to be displayed; step 2, calculating an actual brightness value of each sub-pixel, the actual brightness value of a sub-pixel to be calculated is a sum of a part of the theoretical brightness value of the sub-pixel to be calculated and a part of the theoretical brightness values of a plurality of auxiliary sub-pixels corresponding to the sub-pixel to be calculated; and step 3, outputting a signal to each sub-pixel so that the brightness value of each sub-pixel reaches the actual brightness value thereof which is obtained in the step 2. The present invention further provides a driving module of a pixel array and a display device.

20 Claims, 9 Drawing Sheets

(56) References Cited

U.S. PATENT DOCUMENTS

| | | | | |
|---|---|---|---|---|
| 2009/0027425 | A1 | 1/2009 | Park et al. | |
| 2012/0162172 | A1* | 6/2012 | Lee | H04N 13/0454 345/209 |
| 2012/0287168 | A1* | 11/2012 | Botzas | G09G 3/3413 345/690 |

FOREIGN PATENT DOCUMENTS

| | | | |
|---|---|---|---|
| CN | 103576366 | A | 2/2014 |
| CN | 103714751 | A | 4/2014 |
| CN | 103824520 | A | 5/2014 |
| CN | 103928498 | A | 7/2014 |
| TW | 200923879 | A | 6/2009 |

* cited by examiner

| | | | | | | | | | | | | | | | |
|---|---|---|---|---|---|---|---|---|---|---|---|---|---|---|---|
| (a) | B | G | X | R | (b) | B | G | R | X | (c) | B | R | X | G |
| | X | R | B | G | | X | R | B | G | | X | G | R | B |
| (d) | B | R | X | G | (e) | B | R | X | G | (f) | G | B | X | R |
| | X | G | B | R | | G | X | B | R | | X | R | G | B |
| (g) | G | R | X | B | (h) | G | B | R | X | (i) | G | R | B | X |
| | X | B | G | R | | X | R | G | B | | X | B | G | R |
| (j) | G | R | X | B | (k) | X | B | G | R | | | | | |
| | X | B | G | R | | G | R | X | B | | | | | |

Fig. 17

DRIVING METHOD OF PIXEL ARRAY, DRIVING MODULE OF PIXEL ARRAY AND DISPLAY DEVICE

FIELD OF THE INVENTION

The present invention relates to the field of display technology, and particularly to a driving method of a pixel array, a driving module of a pixel array used for performing the driving method of a pixel array and a display device including the driving module of a pixel array.

BACKGROUND OF THE INVENTION

A conventional pixel design used for a display panel in the prior art is as follows: the display is performed by a repeating unit which is composed by three sub-pixels (including a red sub-pixel, a green sub-pixel and a blue sub-pixel) or four sub-pixels (including a red sub-pixel, a green sub-pixel, a blue sub-pixel and a white sub-pixel).

With the increasing requirement on viewing experience of a user when watching a display screen, the resolution of the display panel needs to be increased, i.e., the PPI (pixel per inch) needs to be increased. The increasing resolution of the display panel may significantly increase the difficulty in manufacturing the display panel.

An urgent technical problem to be solved in the art is how to make a display panel with a certain resolution achieve a display effect of a display panel with a higher resolution while the difficulty in the manufacturing process is not increased.

SUMMARY OF THE INVENTION

An object of the present invention is to provide a driving method of a pixel array, driving module of a pixel array used for performing the driving method of a pixel array and a display device including the driving module of a pixel array. The pixel array is driven by the driving method to achieve a high visual resolution of the display device.

In order to achieve the above object, in an aspect of the present invention, there is provided a driving method of a pixel array, the pixel array includes a plurality of repeating units, each repeating unit includes two rows of sub-pixels, each row of sub-pixels comprise four sub-pixels having different colors, and in each repeating unit, the first two sub-pixels in the first row have the same colors as the last two sub-pixels in the second row, and the last two sub-pixels in the first row have the same colors as the first two sub-pixels in the second row, wherein, the driving method includes:

Step 1: obtaining a theoretical brightness value of each sub-pixel for an image to be displayed;

Step 2: calculating an actual brightness value of each sub-pixel, the actual brightness value of a sub-pixel to be calculated is a sum of a part of the theoretical brightness value of the sub-pixel to be calculated and a part of the theoretical brightness values of a plurality of auxiliary sub-pixels corresponding to the sub-pixel to be calculated, wherein the number of the auxiliary sub-pixels corresponding to the sub-pixel to be calculated is three, the color of each auxiliary sub-pixel is the same as the color of the sub-pixel to be calculated, and the sub-pixel to be calculated and the three auxiliary sub-pixels corresponding thereto are located at four apexes of a kite, respectively, or the number of the auxiliary sub-pixels corresponding to the sub-pixel to be calculated is four, the color of each auxiliary sub-pixel is different from the color of the sub-pixel to be calculated, and the four auxiliary sub-pixels are located at four apexes of a parallelogram and the sub-pixel to be calculated is located inside the parallelogram; and Step 3: outputting a signal to each sub-pixel so that the brightness value of each sub-pixel reaches the actual brightness value thereof which is obtained in the step 2.

Preferably, when the number of the auxiliary sub-pixels is four, the parallelogram is a rectangle, the lateral edge of the rectangle is parallel to the rows of the pixel array and the longitudinal edge of the rectangle is parallel to the columns of the pixel array.

Preferably, the pixel array includes a plurality of polarity periods, each polarity period comprises at least two consecutive rows of sub-pixels having the same polarity distribution and at least one row of sub-pixels having a polarity distribution opposite to the polarity distribution of the two consecutive rows of sub-pixels having the same polarity distribution, and in each row, the polarity of a sub-pixel is opposite to the polarity of its adjacent sub-pixel in the row.

Preferably, one polarity period includes nine consecutive rows of sub-pixels, wherein:

the polarity distribution of the sub-pixels in the first row is the same as the polarity distribution of the sub-pixels in the fourth and fifth rows, and is opposite to the polarity distribution of the sub-pixels in the other rows; or the polarity distribution of the sub-pixels in the first row is the same as the polarity distribution of the sub-pixels in the fourth row, and is opposite to the polarity distribution of the sub-pixels in the other rows; or the polarity distribution of the sub-pixels in the first row is the same as the polarity distribution of the sub-pixels in the fourth to sixth rows, and is opposite to the polarity distribution of the sub-pixels in the other rows; or the polarity distribution of the sub-pixels in the first row is the same as the polarity distribution of the sub-pixels in the fourth to seventh rows, and is opposite to the polarity distribution of the sub-pixels in the other rows; or the polarity distribution of the sub-pixels in the first row is the same as the polarity distribution of the sub-pixels in the third to fifth rows, and is opposite to the polarity distribution of the sub-pixels in the other rows; or the polarity distribution of the sub-pixels in the first row is the same as the polarity distribution of the sub-pixels in the third to sixth rows, and is opposite to the polarity distribution of the sub-pixels in the other rows; or the polarity distribution of the sub-pixels in the first row is the same as the polarity distribution of the sub-pixels in the third to seventh rows, and is opposite to the polarity distribution of the sub-pixels in the other rows; or the polarity distribution of the sub-pixels in the first row is the same as the polarity distribution of the sub-pixels in the third to eighth rows, and is opposite to the polarity distribution of the sub-pixels in the other rows.

Preferably, in each repeating unit:

the sub-pixels in the first row are in sequence of a blue sub-pixel, a green sub-pixel, the other color sub-pixel and a red sub-pixel, and the sub-pixels in the second row are in sequence of the other color sub-pixel, a red sub-pixel, a blue sub-pixel and a green sub-pixel; or the sub-pixels in the first row are in sequence of a blue sub-pixel, a green sub-pixel, a red sub-pixel and the other color sub-pixel, and the sub-pixels in the second row are in sequence of the other color sub-pixel, a red sub-pixel, a blue sub-pixel and a green sub-pixel; or the sub-pixels in the first row are in sequence of a blue sub-pixel, a red sub-pixel, the other color sub-pixel and a green sub-pixel, and the sub-pixels in the second row are in sequence of the other color sub-pixel, a green sub-pixel, a red sub-pixel and a blue sub-pixel; or the sub-pixels in the first row are in sequence of a blue sub-pixel, a red sub-pixel, the other color sub-pixel and a green sub-pixel, and the sub-pixels in the second row are in sequence of a green sub-pixel, the other color sub-pixel, a blue sub-pixel and a red sub-pixel; or the sub-pixels in the first row are in sequence of a green sub-pixel, a blue sub-pixel, the other color sub-pixel and a red sub-pixel, and the sub-pixels in the second row are in sequence of the other color sub-pixel, a red sub-pixel, a green sub-pixel and a blue sub-pixel; or the sub-pixels in the first row are in sequence of a green sub-pixel, a red sub-pixel, the other color sub-pixel and a blue sub-pixel, and the sub-pixels in the second row are in sequence of the other color sub-pixel, a blue sub-pixel, a green sub-pixel and a red sub-pixel; or the sub-pixels in the first row are in sequence of a green sub-pixel, a blue sub-pixel, a red sub-pixel and the other color sub-pixel, and the sub-pixels in the second row are in sequence of the other color sub-pixel, a red sub-pixel, a green sub-pixel and a blue sub-pixel; or the sub-pixels in the first row are in sequence of a green sub-pixel, a red sub-pixel, a blue sub-pixel and the other color sub-pixel, and the sub-pixels in the second row are in sequence of the other color sub-pixel, a blue sub-pixel, a green sub-pixel and a red sub-pixel; or the sub-pixels in the first row are in sequence of a green sub-pixel, a red sub-pixel, the other color sub-pixel and a blue sub-pixel, and the sub-pixels in the second row are in sequence of the other color sub-pixel, a blue sub-pixel, a green sub-pixel and a red sub-pixel; or the sub-pixels in the first row are in sequence of the other color sub-pixel, a blue sub-pixel, a green sub-pixel and a red sub-pixel, and the sub-pixels in the second row are in sequence of a green sub-pixel, a red sub-pixel, the other color sub-pixel and a blue sub-pixel.

Preferably, the other color sub-pixel is any one of a yellow sub-pixel, a white sub-pixel, a cyan sub-pixel and a magenta sub-pixel.

In another aspect of the present invention, there is provided a driving module of a pixel array, the pixel array includes a plurality of repeating units, each repeating unit includes two rows of sub-pixels, each row of sub-pixels comprise four sub-pixels having different colors, in each repeating unit, the first two sub-pixels in the first row have the same colors as the last two sub-pixels in the second row, and the last two sub-pixels in the first row have the same colors as the first two sub-pixels in the second row, the driving module of a pixel array includes:

a theoretical brightness value obtaining unit, for obtaining a theoretical brightness value of each sub-pixel for an image to be displayed;

an actual brightness value calculating unit, for calculating an actual brightness value of each sub-pixel, the actual brightness value of a sub-pixel to be calculated is a sum of a part of the theoretical brightness value of the sub-pixel to be calculated and a part of the theoretical brightness values of a plurality of auxiliary sub-pixels corresponding to the sub-pixel to be calculated, wherein:

the number of the auxiliary sub-pixels corresponding to the sub-pixel to be calculated is three, the color of each auxiliary sub-pixel is the same as the color of the sub-pixel to be calculated, and the sub-pixel to be calculated and the three auxiliary sub-pixels corresponding thereto are located at four apexes of a kite, respectively; or the number of the auxiliary sub-pixels corresponding to the sub-pixel to be calculated is four, the color of each auxiliary sub-pixel is different from the color of the sub-pixel to be calculated, the four auxiliary sub-pixels are located at four apexes of a parallelogram, respectively, and the sub-pixel to be calculated is located within the parallelogram; and a signal outputting unit, for outputting a signal to each sub-pixel so that the brightness value of each sub-pixel reaches the actual brightness value thereof which is obtained by the actual brightness value calculating unit.

Preferably, when the number of the corresponding auxiliary sub-pixels is four, the parallelogram is a rectangle, the lateral edge of the rectangle is parallel to the rows of the pixel array and the longitudinal edge of the rectangle is parallel to the columns of the pixel array.

Preferably, the pixel array includes a plurality of polarity periods, each polarity period comprises at least two consecutive rows of sub-pixels having the same polarity distribution and at least one row of sub-pixels having a polarity distribution opposite to the polarity distribution of the two consecutive rows of sub-pixels having the same polarity distribution, and in each row, the polarity of a sub-pixel is opposite to the polarity of its adjacent sub-pixel in the row.

Preferably, one polarity period includes nine consecutive rows of sub-pixels, wherein:

the polarity distribution of the sub-pixels in the first row is the same as the polarity distribution of the sub-pixels in the fourth and fifth rows, and is opposite to the polarity distribution of the sub-pixels in the other rows; or the polarity distribution of the sub-pixels in the first row is the same as the polarity distribution of the sub-pixels in the fourth row, and is opposite to the polarity distribution of the sub-pixels in the other rows; or the polarity distribution of the sub-pixels in the first row is the same as the polarity distribution of the sub-pixels in the fourth to sixth rows, and is opposite to the polarity distribution of the sub-pixels in the other rows; or the polarity distribution of the sub-pixels in the first row is the same as the polarity distribution of the sub-pixels in the fourth to seventh rows, and is opposite to the polarity distribution of the sub-pixels in the other rows; or the polarity distribution of the sub-pixels in the first row is the same as the polarity distribution of the sub-pixels in the third to fifth rows, and is opposite to the polarity distribution of the sub-pixels in the other rows; or the polarity distribution of the sub-pixels in the first row is the same as the polarity distribution of the sub-pixels in the third to sixth rows, and is opposite to the polarity distribution of the sub-pixels in the other rows; or the polarity distribution of the sub-pixels in the first row is the same as the polarity distribution of the sub-pixels in the third to seventh rows, and is opposite to the polarity distribution of the sub-pixels in the other rows; or the polarity distribution of the sub-pixels in the first row is the same as the polarity distribution of the sub-pixels in the third to eighth rows, and is opposite to the polarity distribution of the sub-pixels in the other rows.

Preferably, in each repeating unit:

the sub-pixels in the first row are in sequence of a blue sub-pixel, a green sub-pixel, the other color sub-pixel and a red sub-pixel, and the sub-pixels in the second row are in sequence of the other color sub-pixel, a red sub-pixel, a blue sub-pixel and a green sub-pixel; or the sub-pixels in the first row are in sequence of a blue sub-pixel, a green sub-pixel, a red sub-pixel and the other color sub-pixel, and the sub-pixels in the second row are in sequence of the other color sub-pixel, a red sub-pixel, a blue sub-pixel and a green sub-pixel; or the sub-pixels in the first row are in sequence of a blue sub-pixel, a red sub-pixel, the other color sub-pixel and a green sub-pixel, and the sub-pixels in the second row are in sequence of the other color sub-pixel, a green sub-pixel, a red sub-pixel and a blue sub-pixel; or the sub-pixels in the first row are in sequence of a blue sub-pixel, a red sub-pixel, the other color sub-pixel and a green sub-pixel, and the sub-pixels in the second row are in sequence of a green sub-pixel, the other color sub-pixel, a blue sub-pixel and a red sub-pixel; or the sub-pixels in the first row are in sequence of a green sub-pixel, a blue sub-pixel, the other color sub-pixel and a red sub-pixel, and the sub-pixels in the second row are in sequence of the other color sub-pixel, a red sub-pixel, a green sub-pixel and a blue sub-pixel; or the sub-pixels in the first row are in sequence of a green sub-pixel, a red sub-pixel, the other color sub-pixel and a blue sub-pixel, and the sub-pixels in the second row are in sequence of the other color sub-pixel, a blue sub-pixel, a green sub-pixel and a red sub-pixel; or the sub-pixels in the first row are in sequence of a green sub-pixel, a blue sub-pixel, a red sub-pixel and the other color sub-pixel, and the sub-pixels in the second row are in sequence of the other color sub-pixel, a red sub-pixel, a green sub-pixel and a blue sub-pixel; or the sub-pixels in the first row are in sequence of a green sub-pixel, a red sub-pixel, a blue sub-pixel and the other color sub-pixel, and the sub-pixels in the second row are in sequence of the other color sub-pixel, a blue sub-pixel, a green sub-pixel and a red sub-pixel; or the sub-pixels in the first row are in sequence of a green sub-pixel, a red sub-pixel, the other color sub-pixel and a blue sub-pixel, and the sub-pixels in the second row are in sequence of the other color sub-pixel, a blue sub-pixel, a green sub-pixel and a red sub-pixel; or the sub-pixels in the first row are in sequence of the other color sub-pixel, a blue sub-pixel, a green sub-pixel and a red sub-pixel, and the sub-pixels in the second row are in sequence of a green sub-pixel, a red sub-pixel, the other color sub-pixel and a blue sub-pixel.

Preferably, the other color sub-pixel is any one of a yellow sub-pixel, a white sub-pixel, a cyan sub-pixel and a magenta sub-pixel.

In still another aspect of the present invention, there is provided a display device, including a pixel array and a driving module of the pixel array, the driving module of a pixel array is used for driving the pixel array, wherein:

the pixel array includes a plurality of repeating units, and each repeating unit includes two rows of sub-pixels, each row of sub-pixel comprises four sub-pixels having different colors. In each repeating unit, the first two pixels in the first row have the same colors as the last two pixels in the second row, and the last two pixels in the first row have the same colors as the first two pixels in the second row; and the driving module of a pixel array is the above-mentioned driving module of a pixel array.

In the driving method according to the present invention, the actual brightness value outputted to a sub-pixel is a sum of a part of the theoretical brightness value thereof and a part of the theoretical brightness values of the auxiliary sub-pixels corresponding to the sub-pixel. That is, a sub-pixel shares brightness signals of other sub-pixels (this sharing is referred to as "color sharing" in the present invention) when a display is performed. When the above-mentioned driving method is used for driving a pixel array in a display panel according to the present invention, a display effect of a higher visual resolution can be achieved by the display panel while the physical resolution thereof remains unchanged.

BRIEF DESCRIPTION OF THE DRAWINGS

Accompanying drawings are used to provide further understanding of the present invention, and constitute a part of the specification, and will be used to interpret the present invention in conjunction with the following embodiments and will not limit the present invention to the precise forms. In the drawings:

FIG. 17 is a diagram illustrating the arrangements of the sub-pixels in each repeating unit, which are suitable for the driving method of a pixel array according to the present invention.

DETAILED DESCRIPTION OF THE EMBODIMENTS

Embodiments of the present invention will be described in more detail in conjunction with the accompanying drawings. It should be understood that, the embodiments described herein are merely used for illustrating and explaining the present invention, but not intended to limit the scope of the present invention.

In an aspect of the present invention, there is provided a driving method of a pixel array. As shown in FIGS. 1 to 6, the pixel array includes a plurality of repeating units, and each repeating unit includes two rows of sub-pixels, each row of sub-pixels comprise four sub-pixels having different colors. In each repeating unit, the first two sub-pixels in the first row have the same colors as the last two sub-pixels in the second row, and the last two sub-pixels in the first row have the same colors as the first two pixels in the second row. Wherein, the driving method includes the following steps.

Step 1: obtaining a theoretical brightness value of each sub-pixel for an image to be displayed.

Step 2: calculating an actual brightness value of each sub-pixel. The actual brightness value of a sub-pixel to be calculated is a sum of a part of the theoretical brightness value of the sub-pixel to be calculated and a part of the theoretical brightness values of a plurality of auxiliary sub-pixels corresponding to the sub-pixel to be calculated.

Figure 1:
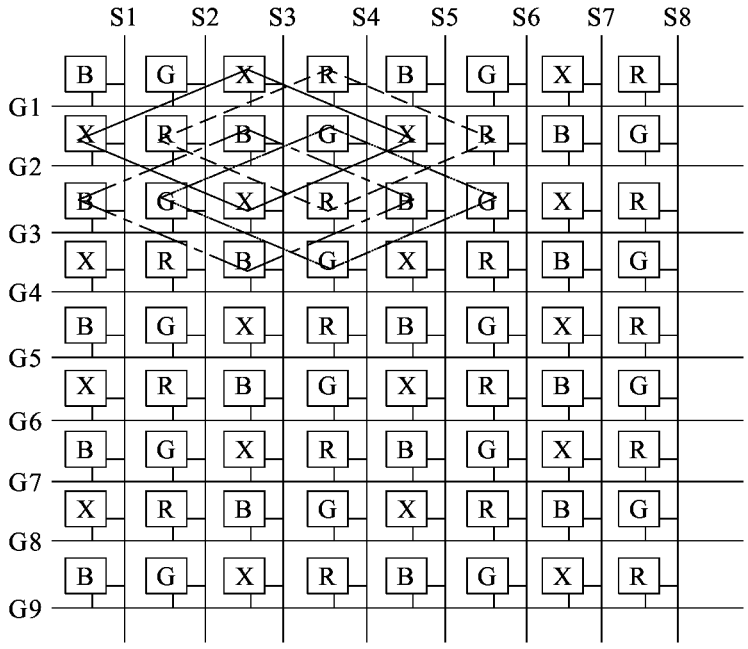
FIG. 1 is a diagram illustrating a first implementation of the color sharing in the driving method of a pixel array according to the present invention.

According to one embodiment of the present invention, as shown in FIG. 1, the number of the auxiliary sub-pixels corresponding to the sub-pixel to be calculated is three. The color of each auxiliary sub-pixel is the same as the color of the sub-pixel to be calculated. The sub-pixel to be calculated and the three auxiliary sub-pixels corresponding thereto are located at four apexes of a kite (a kite is a quadrilateral of which four sides can be grouped into two pairs of equal-length sides that are adjacent to each other), such as a rhombus, respectively.

Figure 2:
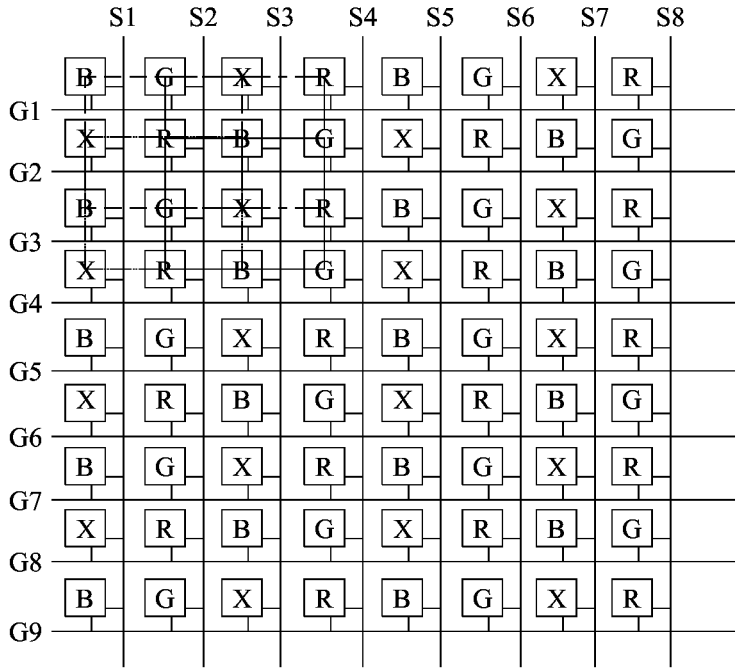
FIG. 2 is a diagram illustrating a second implementation of the color sharing in the driving method of a pixel array according to the present invention.

According to another embodiment of the present invention, as shown in FIG. 2, the number of the auxiliary sub-pixels corresponding to the sub-pixel to be calculated is four. The color of each auxiliary sub-pixel is different from the color of the sub-pixel to be calculated. The four auxiliary sub-pixels are located at four apexes of a parallelogram, such as a square, respectively, and the sub-pixel to be calculated is located inside the parallelogram.

Step 3: outputting a signal to each sub-pixel so that the brightness value of each sub-pixel reaches the actual brightness value thereof which is obtained in the step 2.

In the driving method according to the present invention, the actual brightness value outputted to a sub-pixel is a sum of a part of the theoretical brightness value thereof and a part of the theoretical brightness values of the plurality of corresponding auxiliary sub-pixels. That is, each sub-pixel shares brightness (it may also be saturation or any other factor that affects a display effect, this sharing process is refer to as "color sharing" in the present invention) of other sub-pixels. When the above-mentioned driving method is used for driving a pixel array in a display panel according to the present invention, a display effect of a higher visual resolution can be realized on the display panel while the physical resolution thereof remains unchanged.

As shown in FIGS. 1 to 6, a repeating unit includes sub-pixels of four colors: red sub-pixels R, green sub-pixels G, blue sub-pixels B, and the other color sub-pixels X (referred to as "sub-pixel X" for short). In a manufacturing process, the color of the sub-pixel X is determined by an actual application. For example, the color of the sub-pixel X may be white when the display panel is required to have a high brightness, and the color of the sub-pixel X may be yellow or cyan when the display panel is required to have a wide color gamut.

The term "theoretic brightness value" in the present invention indicates a brightness value of a sub-pixel in a pixel array which is driven by a driving method of a pixel array in the prior art. It is easy to obtain the theoretic brightness value of a sub-pixel for a person skilled in the art. So the details for obtaining the theoretic brightness value will not described in the present invention.

FIG. 1 shows a first implementation of the color sharing.

When a sub-pixel X at row G2, column S1 is the sub-pixel to be calculated, the corresponding auxiliary sub-pixels are a sub-pixel X at row G1, column S3, a sub-pixel X at row G2, column S5 and a sub-pixel X at row G3, column S3.

When a red sub-pixel R at row G2, column S2 is the sub-pixel to be calculated, the corresponding auxiliary sub-pixels are a red sub-pixel R at row G1, column S4, a red sub-pixel R at row G2, column S6 and a red sub-pixel R at row G3, column S4.

When a blue sub-pixel B at row G3, column S1 is the sub-pixel to be calculated, the corresponding auxiliary sub-pixels are a blue sub-pixel B at row G2, column S3, a blue sub-pixel B at row G3, column S5 and a blue sub-pixel B at row G4, column S3.

When a green sub-pixel G at row G3, column S2 is the sub-pixel to be calculated, the corresponding auxiliary sub-pixels are a green sub-pixel G at row G2, column S4, a green sub-pixel G at row G3, column S6 and a green sub-pixel G at row G4, column S4.

FIGS. 2 to 6 show a second implementation of the color sharing.

Figure 3:
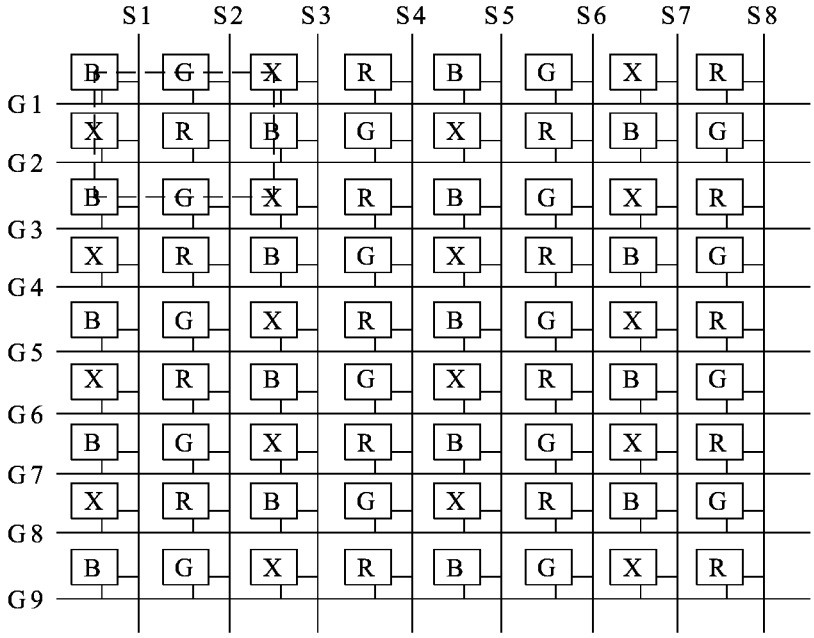
FIG. 3 is a diagram illustrating a sharing relationship for a red sub-pixel in the second embodiment of the color sharing.

As shown in FIGS. 2 and 3, when a red sub-pixel R at row G2, column S2 is the sub-pixel to be calculated, the corresponding auxiliary sub-pixels are a blue sub-pixel B at row G1, column S1, a sub-pixel X at row G1, column S3, a blue sub-pixel B at row G3, column S1 and a sub-pixel X at row G3, column S3.

Figure 4:
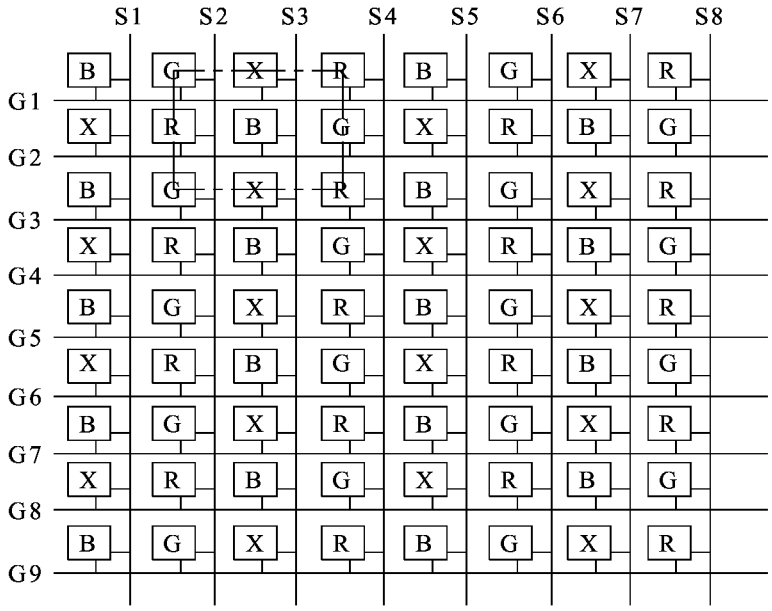
FIG. 4 is a diagram illustrating a sharing relationship for a blue sub-pixel in the second embodiment of the color sharing.

As shown in FIGS. 2 and 4, when a blue sub-pixel B at row G2, column S3 is the sub-pixel to be calculated, the corresponding auxiliary sub-pixels are a green sub-pixel G at row G1, column S2, a red sub-pixel R at row G1, column S4, a green sub-pixel G at row G3, column S2 and a red sub-pixel R at row G3, column S4.

Figure 5:
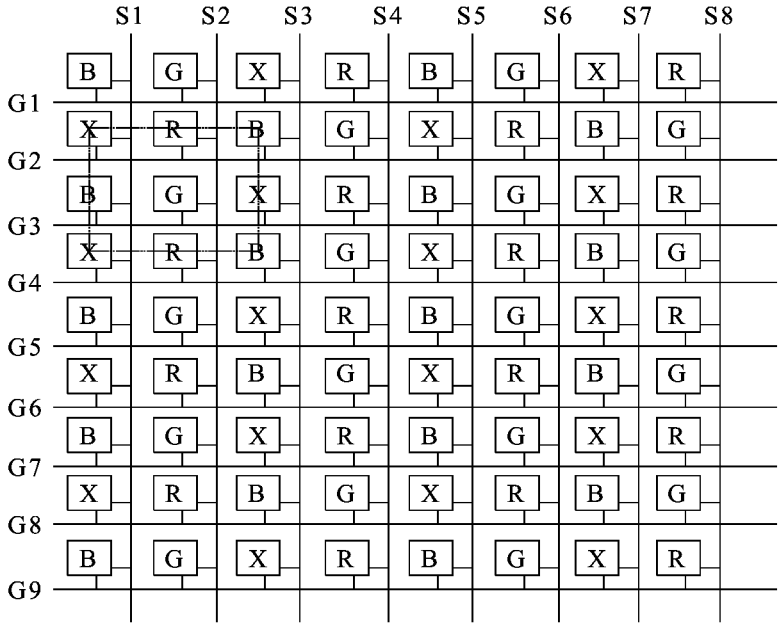
FIG. 5 is a diagram illustrating a sharing relationship for a green sub-pixel in the second embodiment of the color sharing.

As shown in FIGS. 2 and 5, when a green sub-pixel G at row G3, column S2 is the sub-pixel to be calculated, the corresponding auxiliary sub-pixels are a sub-pixel X at row G2, column S1, a blue sub-pixel B at row G2, column S3, a sub-pixel X at row G4, column S1 and a blue sub-pixel B at row G4, column S3.

Figure 6:
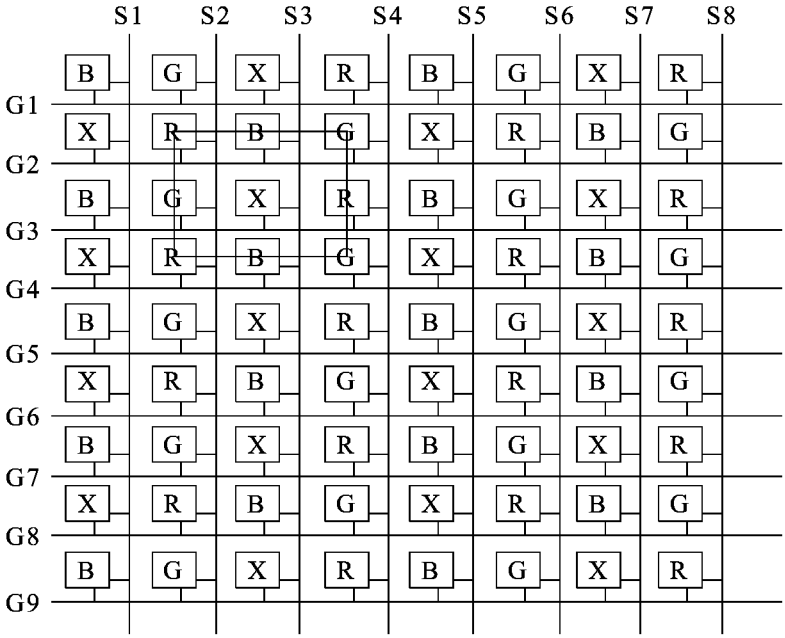
FIG. 6 is a diagram illustrating a sharing relationship for the other color sub-pixel in the second embodiment of the color sharing.

As shown in FIGS. 2 and 6, when a sub-pixel X at row G3, column S3 is the sub-pixel to be calculated, the corresponding auxiliary sub-pixels are a red sub-pixel R at row G2, column S2, a green sub-pixel G at row G2, column S4, a red sub-pixel R at row G4, column S2 and a green sub-pixel G at row G4, column S4.

As described above, when the number of the corresponding auxiliary sub-pixels is four, the four auxiliary sub-pixels are located at four apexes of a rectangle. The lateral edge of the rectangle is parallel to the rows of the pixel array, and the longitudinal edge of the rectangle is parallel to the columns of the pixel array. Of course, the rectangle may be a square.

The driving method of a pixel array according to the present invention is suitable for an OLED display panel or a liquid crystal display panel. When the display panel is a liquid crystal display panel, a liquid crystal material is disposed in the areas corresponding to the sub-pixels of the pixel array. Liquid crystal molecules of the liquid crystal material are rotated by an electric field generated between a pixel electrode and a common electrode, so as to perform a display.

In the present invention, each sub-pixel includes a pixel electrode and a common electrode, the direction of the electric field generated between the pixel electrode and the common electrode in each sub-pixel is referred to as "the polarity of the sub-pixel". For example, when the voltage level of the pixel electrode is higher than the voltage level of the common electrode in a sub-pixel, the direction of the electric field generated therebetween is from the pixel electrode to the common electrode, so the polarity of the sub-pixel is positive. On the contrary, when the voltage level of the pixel electrode is lower than the voltage level of the common electrode in a sub-pixel, the direction of the electric field generated therebetween is from the common electrode to the pixel electrode, so the polarity of the sub-pixel is negative. When performing a display by the pixel array according to the present invention, the polarity of each sub-pixel needs to be inversed, i.e., the voltage levels of the pixel electrode and the common electrode need to be alternated continuously therebetween.

Figure 7:
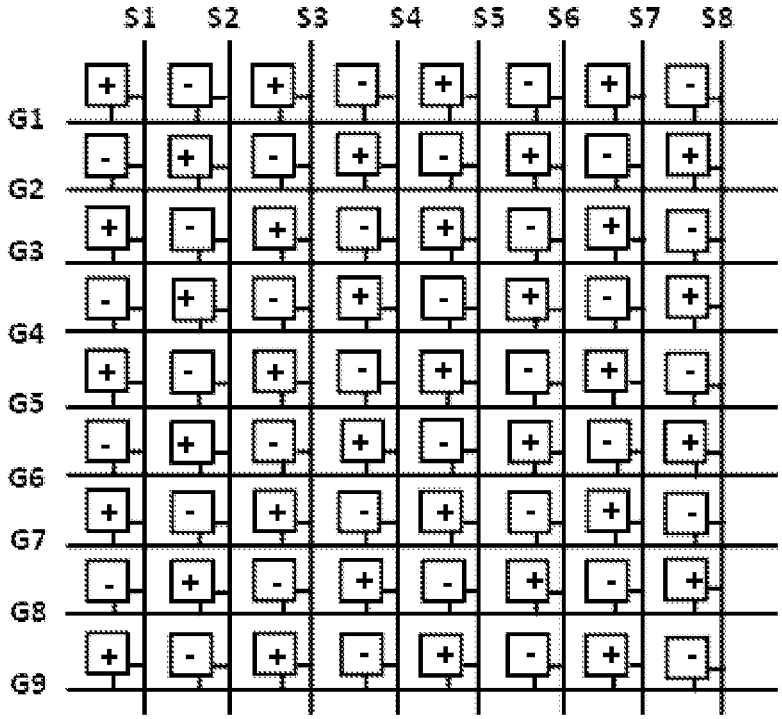
FIG. 7 is a diagram illustrating a first polarity inversion way in the driving method of a pixel array according to the present invention.

In the present invention, the specific polarity inversion way of the pixel array is not particularly limited. For example, FIG. 7 shows a first polarity inversion way. In FIG. 7, a dot inversion way is used for the polarity inversion of the pixel array. That is, for any sub-pixel, the polarity of the sub-pixel is opposite to the polarity of its adjacent sub-pixel. Particularly, when a previous frame of an image is displayed, the polarity of the sub-pixel at row G1, column S1 is positive, and the polarities of the sub-pixel at row G1, column S2 and the sub-pixel at row G2, column S1, which are adjacent to the sub-pixel at row G1, column S1, are negative. When the next frame (the next frame of the above-mentioned previous frame) of the image is displayed, the polarity of the each sub-pixel is inversed, i.e., the polarity of the sub-pixel at row G1, column S1 becomes negative, and the polarities of the sub-pixel at row G1, column S2 and the sub-pixel at row G2, column S1 become positive.

Figure 8:
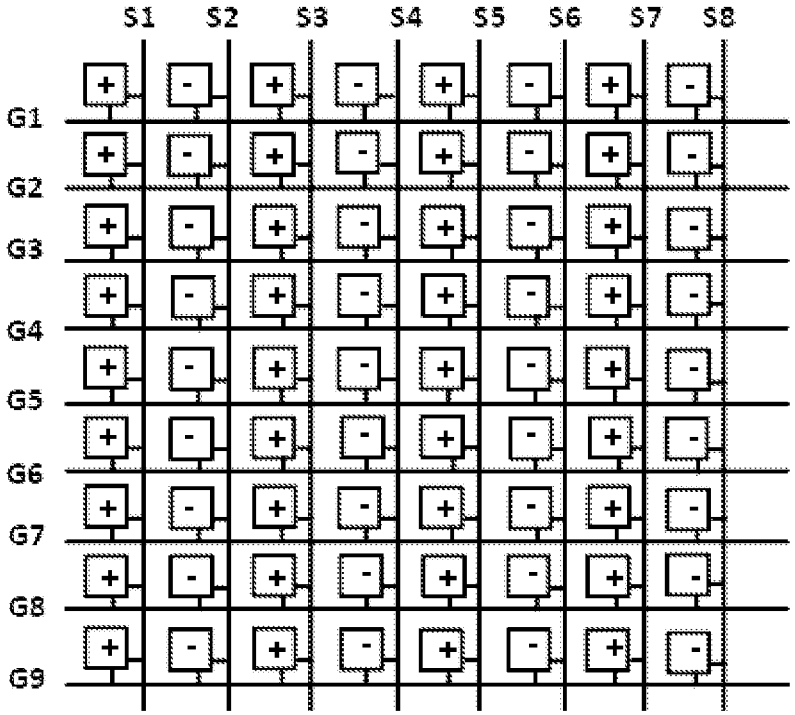
FIG. 8 is a diagram illustrating a second polarity inversion way in the driving method of a pixel array according to the present invention.

FIG. 8 shows a second polarity inversion way. In FIG. 8, a column inversion way is used for the polarity inversion of the pixel array. That is, the polarities of the sub-pixels in the same column are the same, and are different from the polarities of the sub-pixels in the adjacent columns. Particularly, when a previous frame of an image is displayed, the polarity of each sub-pixel in column S2 is negative, and the polarities of the sub-pixels in columns S1 and S3, which are adjacent to the column S2, are positive. When the next frame of the image is displayed, the polarity of each sub-pixel in column S2 becomes positive, the polarities of the sub-pixels in columns S1 and S3, which are adjacent to the column S2, become negative.

As preferred embodiments of the present invention, as shown in FIGS. 9 to 16, the pixel array includes a plurality of polarity periods. Each polarity period comprises at least two consecutive rows of sub-pixels having the same polarity distribution and at least one row of sub-pixels having a polarity distribution opposite to the polarity distribution of the two consecutive rows of sub-pixels having the same polarity distribution.

It should be noted that, in the present invention, the "polarity period" is not a time period illustrating the polarity variation of the sub-pixel, but is a "region". The sub-pixels in a pixel array are divided into a plurality of regions which are arranged in sequence, each region has sub-pixels of the same number. Moreover, the polarities of the sub-pixels, which are located at corresponding positions in various regions, are the same. Here, a "region" is a so-called "polarity period". Therefore, in the present invention, the "polarity period" is a spatial period. For example, if a polarity of a sub-pixel at row 1, column 1 in a polarity period is "+" (i.e., positive), the polarity of a sub-pixel at row 1, column 1 in the next polarity period is also "+", and so on.

Here, the "at least two consecutive rows of sub-pixels" means at least two rows of sub-pixels arranged in sequence. For example, in one polarity period, the first row of sub-pixels and the second row of sub-pixels are the two consecutive rows of sub-pixels. The first row of sub-pixels, the second row of sub-pixels, and the third row of sub-pixels are the three consecutive rows of sub-pixels, and so on.

The "polarity distribution" indicates the polarities of all the sub-pixels in one row. For example, in FIG. 9, the polarity distribution of sub-pixels in row G1 is "+−+−+−+−" ("−" indicates "negative" and "+" indicates "positive"). And the polarity distribution of sub-pixels in row G2 is "−+−+−+−+". The "each polarity period comprises at least two consecutive rows of sub-pixels which have the same polarity distribution" means that, when driving the sub-pixels in a polarity period, the sub-pixels located at corresponding positions in two or more consecutive rows have the same polarity, and is not intend to indicate that the polarity of each sub-pixel in the two or more rows is the same. For example, in a polarity period as shown in FIG. 9, sub-pixels in row G2 and row G3 are two consecutive rows of sub-pixels, so the polarity of the sub-pixel at row G2, column S1 is the same as that at row G3, column S1, and the polarity of sub-pixel at row G2, column S2 is the same as that at row G3, column S2, and so on.

"At least one row of sub-pixels having a polarity distribution opposite to the polarity distribution of the two consecutive rows of sub-pixels having the same polarity distribution" means: in each column, the polarity of a sub-pixel in the at least one row is opposite to the polarity of the sub-pixels in the at least two consecutive rows having the same polarity distribution. For example, in FIG. 9, as described above, sub-pixels in row G2 and row G3 are the two consecutive rows of sub-pixels having the same polarity distribution, and the polarity of each sub-pixel in row G1 is opposite to the polarities of corresponding sub-pixels in row G2 and the row G3. Particularly, the polarity distribution of sub-pixels in row G1 is "+−+−+−+−", and the polarity distribution of sub-pixels in row G2 and row G3 are "−+−+−+−+".

In each column, the color of a sub-pixel is different from the color of its adjacent sub-pixel by using the repeating unit according to the embodiments of the present invention, so that the crosstalk coupling between the sub-pixels having the same color when the polarities of the sub-pixels are inversed synchronously can be reduced to some extent without the dot inversion way in the prior art. Comparing to the dot inversion way in FIG. 7, the polarity inversion way according to the present invention can save more energy; and comparing to the column inversion way in FIG. 8, the polarity inversion way according to the present invention can prevent the liquid crystal molecules from being of aging and improve the display effect. It should be pointed out that, in the present invention, the polarity of any sub-pixel is opposite to the polarities of its adjacent sub-pixels in the same row. For example, as shown in FIG. 9, the polarity of the sub-pixel at row G1, column S2 is opposite to the polarity of the sub-pixel at row G1, column S1, and is also opposite to the polarity of the sub-pixel at row G1, column S3. In the present invention, the number and the polarity distribution of the sub-pixels in a polarity period are not particularly limited. For example, a polarity period may comprise nine consecutive rows of sub-pixels, and each row of sub-pixels has nine sub-pixels.

Figure 9:
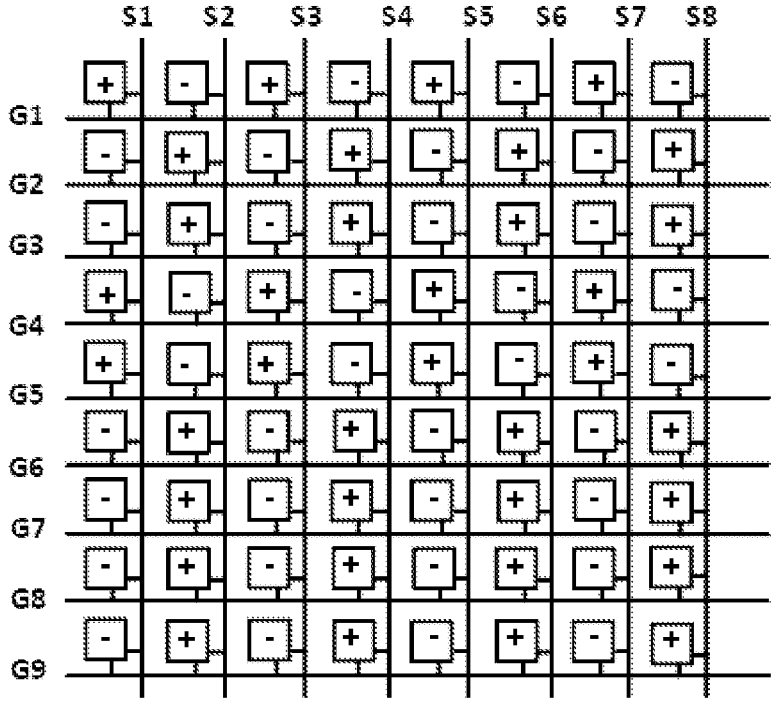
FIG. 9 is a diagram illustrating a third polarity inversion way in the driving method of a pixel array according to the present invention.

As shown in FIG. 9, as the third implementation of polarity inversion in the driving method according to the present invention, in a polarity period, the polarity distribution of the sub-pixels in the first row is the same as the polarity distribution of the sub-pixels in the fourth and fifth rows, and is opposite to the polarity distribution of the sub-pixels in the other rows.

Figure 10:
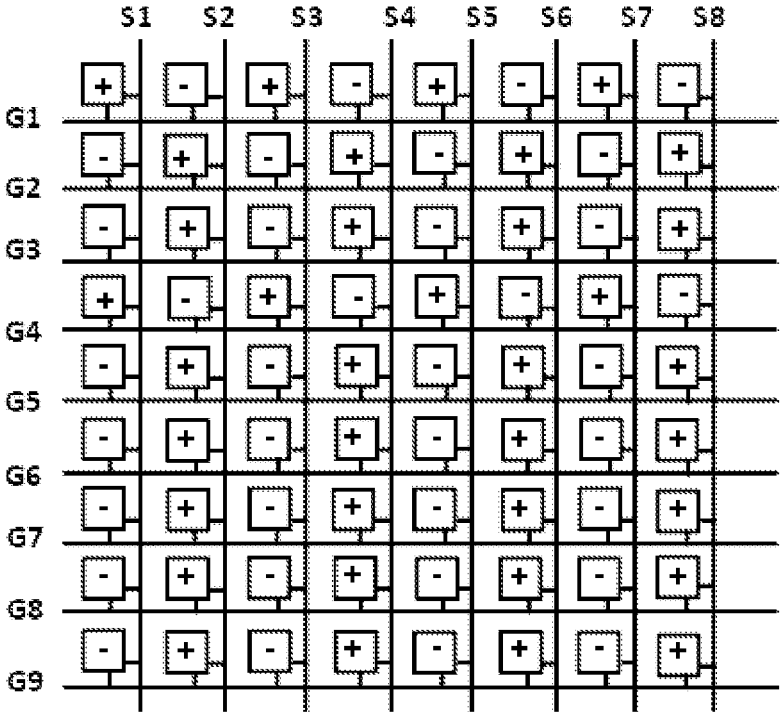
FIG. 10 is a diagram illustrating a fourth polarity inversion way in the driving method of a pixel array according to the present invention.

Optionally, as shown in FIG. 10, as the fourth implementation of polarity inversion in the driving method according to the present invention, in a polarity period, the polarity distribution of the sub-pixels in the first row is the same as the polarity distribution of the sub-pixels in the fourth row, and is opposite to the polarity distribution of the sub-pixels in the other rows.

Figure 11:
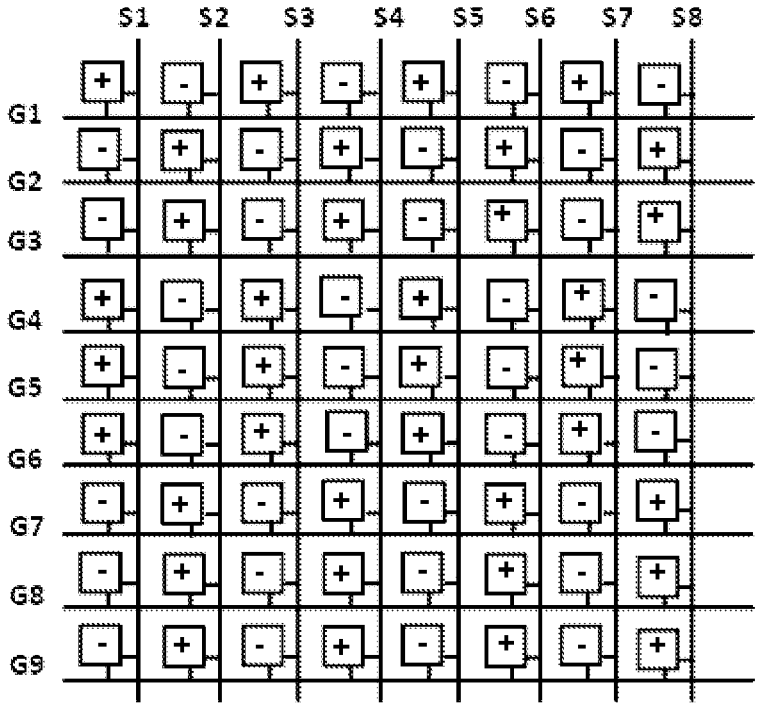
FIG. 11 is a diagram illustrating a fifth polarity inversion way in the driving method of a pixel array according to the present invention.

Optionally, as shown in FIG. 11, as the fifth implementation of polarity inversion in the driving method according to the present invention, in a polarity period, the polarity distribution of the sub-pixels in the first row is the same as the polarity distribution of the sub-pixels in the fourth to sixth rows, and is opposite to the polarity distribution of the sub-pixels in the other rows.

Figure 12:
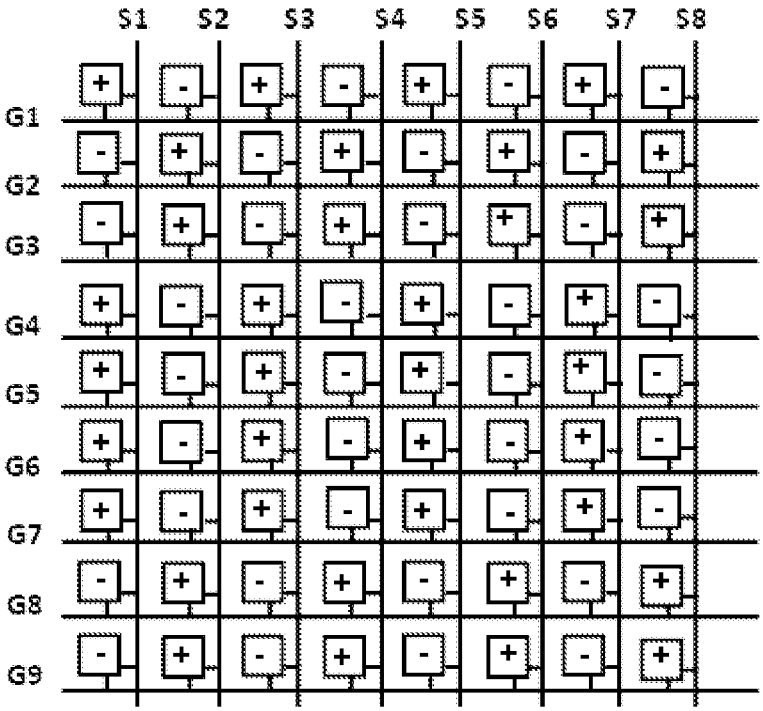
FIG. 12 is a diagram illustrating a sixth polarity inversion way in the driving method of a pixel array according to the present invention.

Optionally, as shown in FIG. 12, as the sixth implementation of polarity inversion in the driving method according to the present invention, in a polarity period, the polarity distribution of the sub-pixels in the first row is the same as the polarity distribution of the sub-pixels in the fourth to seventh rows, and is opposite to the polarity distribution of the sub-pixels in the other rows.

Figure 13:
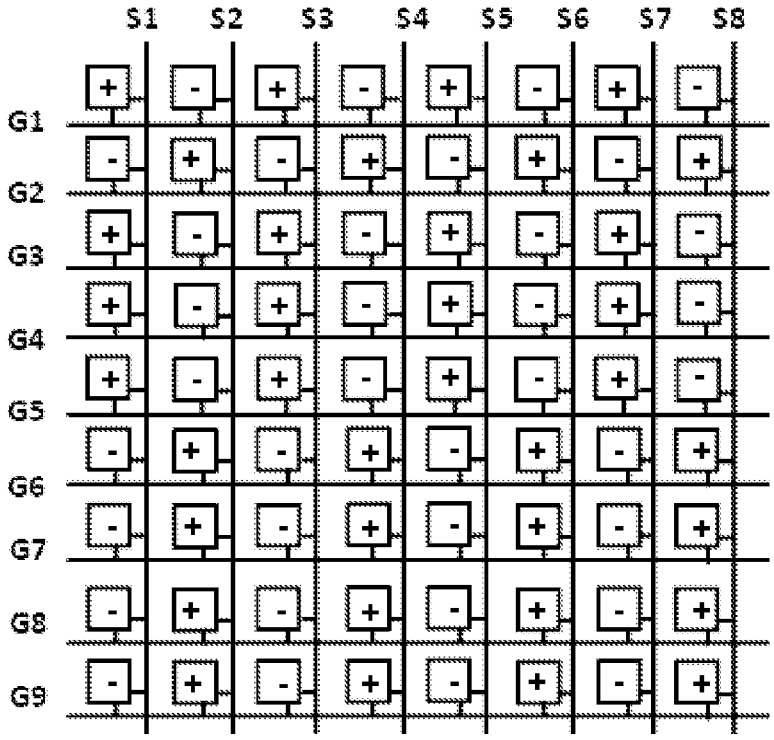
FIG. 13 is a diagram illustrating a seventh polarity inversion way in the driving method of a pixel array according to the present invention.

Optionally, as shown in FIG. 13, as the seventh implementation of polarity inversion in the driving method according to the present invention, in a polarity period, the polarity distribution of the sub-pixels in the first row is the same as the polarity distribution of the sub-pixels in the third to fifth rows, and is opposite to the polarity distribution of the sub-pixels in the other rows.

Figure 14:
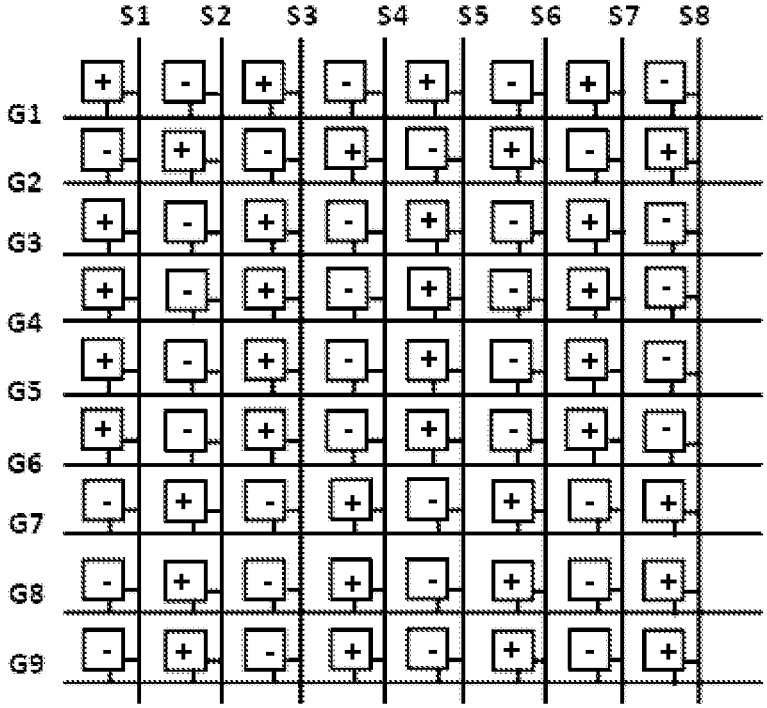
FIG. 14 is a diagram illustrating an eighth polarity inversion way in the driving method of a pixel array according to the present invention.

Optionally, as shown in FIG. 14, as the eighth implementation of polarity inversion in the driving method according to the present invention, in a polarity period, the polarity distribution of the sub-pixels in the first row is the same as the polarity distribution of the sub-pixels in the third to sixth rows, and is opposite to the polarity distribution of the sub-pixels in the other rows.

Figure 15:
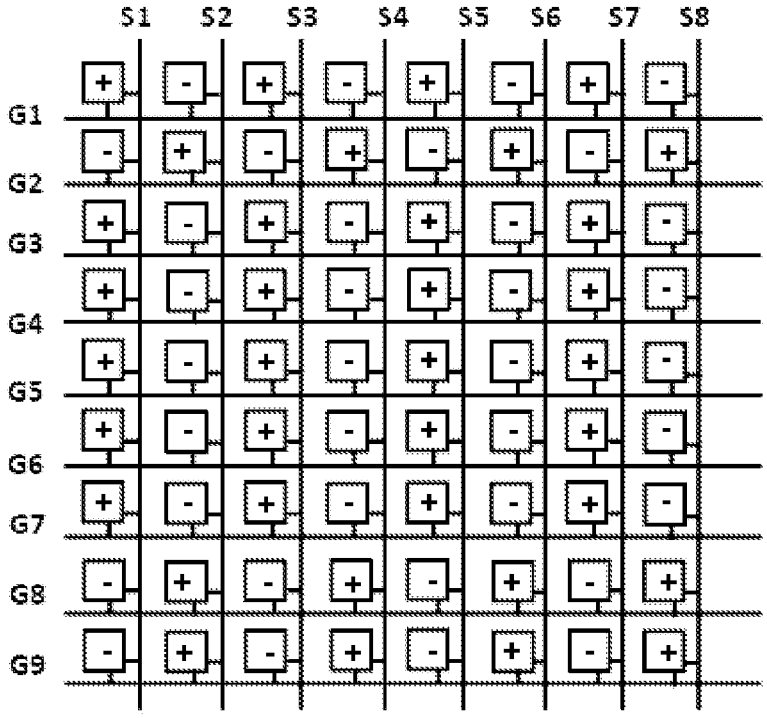
FIG. 15 is a diagram illustrating a ninth polarity inversion way in the driving method of a pixel array according to the present invention.

Optionally, as shown in FIG. 15, as the ninth implementation of polarity inversion in the driving method according to the present invention, in a polarity period, the polarity distribution of the sub-pixels in the first row is the same as the polarity distribution of the sub-pixels in the third to seventh rows, and is opposite to the polarity distribution of the sub-pixels in the other rows.

Figure 16:
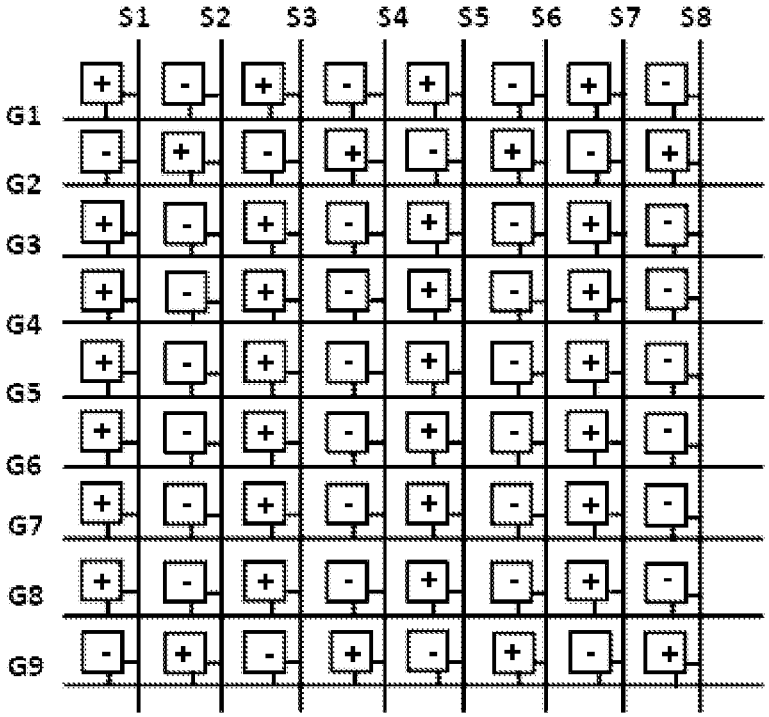
FIG. 16 is a diagram illustrating a tenth polarity inversion way in the driving method of a pixel array according to the present invention.

Optionally, as shown in FIG. 16, as the tenth implementation of polarity inversion in the driving method according to the present invention, in a polarity period, the polarity distribution of the sub-pixels in the first row is the same as the polarity distribution of the sub-pixels in the third to eighth rows, and is opposite to the polarity distribution of the sub-pixels in the other rows.

In the present invention, the specific configuration of each repeating unit in the pixel array is not particularly limited. In order to achieve a color uniformity of the pixel array when performing a display, preferably, in each repeating unit:

as shown in (a) of FIG. 17, the sub-pixels in the first row are in sequence of a blue sub-pixel B, a green sub-pixel G, a sub-pixel X and a red sub-pixel R, and the sub-pixels in the second row are in sequence of a sub-pixel X, a red sub-pixel R, a blue sub-pixel B and a green sub-pixel G; or as shown in (b) of FIG. 17, the sub-pixels in the first row are in sequence of a blue sub-pixel B, a green sub-pixel G, a red sub-pixel R and a sub-pixel X, and the sub-pixels in the second row are in sequence of a sub-pixel X, a red sub-pixel R, a blue sub-pixel B and a green sub-pixel G; or as shown in (c) of FIG. 17, the sub-pixels in the first row are in sequence of a blue sub-pixel B, a red sub-pixel R, a sub-pixel X and a green sub-pixel G, and the sub-pixels in the second row are in sequence of a sub-pixel X, a green sub-pixel G, a red sub-pixel R and a blue sub-pixel B; or as shown in (d) of FIG. 17, the sub-pixels in the first row are in sequence of a blue sub-pixel B, a red sub-pixel R, a sub-pixel X and a green sub-pixel G, and the sub-pixels in the second row are in sequence of a sub-pixel X, a green sub-pixel G, a blue sub-pixel B and a red sub-pixel R; or as shown in (e) of FIG. 17, the sub-pixels in the first row are in sequence of a blue sub-pixel B, a red sub-pixel R, a sub-pixel X and a green sub-pixel G, and the sub-pixels in the second row are in sequence of a green sub-pixel G, a sub-pixel X, a blue sub-pixel B and a red sub-pixel R; or as shown in (f) of FIG. 17, the sub-pixels in the first row are in sequence of a green sub-pixel G, a blue sub-pixel B, a sub-pixel X and a red sub-pixel R, and the sub-pixels in the second row are in sequence of a sub-pixel X, a red sub-pixel R, a green sub-pixel G and a blue sub-pixel B; or as shown in (g) of FIG. 17, the sub-pixels in the first row are in sequence of a green sub-pixel G, a red sub-pixel R, a sub-pixel X and a blue sub-pixel B, and the sub-pixels in the second row are in sequence of a sub-pixel X, a blue sub-pixel B, a green sub-pixel G and a red sub-pixel R; or as shown in (h) of FIG. 17, the sub-pixels in the first row are in sequence of a green sub-pixel G, a blue sub-pixel B, a red sub-pixel R and a sub-pixel X, and the sub-pixels in the second row are in sequence of a sub-pixel X, a red sub-pixel R, a green sub-pixel G and a blue sub-pixel B; or as shown in (i) of FIG. 17, the sub-pixels in the first row are in sequence of a green sub-pixel G, a red sub-pixel R, a blue sub-pixel B and a sub-pixel X, and the sub-pixels in the second row are in sequence of a sub-pixel X, a blue sub-pixel B, a green sub-pixel G and a red sub-pixel R; or as shown in (j) of FIG. 17, the sub-pixels in the first row are in sequence of a green sub-pixel G, a red sub-pixel R, a sub-pixel X and a blue sub-pixel B, and the sub-pixels in the second row are in sequence of a sub-pixel X, a blue sub-pixel B, a green sub-pixel G and a red sub-pixel R; or as shown in (k) of FIG. 17, the sub-pixels in the first row are in sequence of a sub-pixel X, a blue sub-pixel B, a green sub-pixel G and a red sub-pixel R, and the sub-pixels in the second row are in sequence of a green sub-pixel G, a red sub-pixel R, a sub-pixel X and a blue sub-pixel B.

The sub-pixel X may be any one of a yellow sub-pixel, a white sub-pixel, a cyan sub-pixel and a magenta sub-pixel. The color of the sub-pixel X may be selected according to an application of the pixel array. For example, the color of the sub-pixel X may be white when the display panel is required to have a high brightness; and the color of the sub-pixel X may be yellow, cyan or magenta when the display panel is required to have a wide color gamut.

The sub-pixels in each repeating unit may be arranged in many other orders, which will be omitted herein.

In another aspect of the present invention, there is provided a driving module of a pixel array, the pixel array includes a plurality of repeating units, each repeating unit includes two rows of sub-pixels, and each row of sub-pixels comprise four sub-pixels having different colors. In each repeating unit, the first two sub-pixels in the first row have the same colors as the last two sub-pixels in the second row, and the last two sub-pixels in the first row have the same colors as the first two sub-pixels in the second row. The driving module of a pixel array includes the following units:

1. A theoretical brightness value obtaining unit, for obtaining a theoretical brightness value of each sub-pixel for an image to be displayed (for performing Step 1);

2. An actual brightness value calculating unit, for calculating an actual brightness value of each sub-pixel (for performing Step 2). The actual brightness value of a sub-pixel to be calculated is a sum of a part of the theoretical brightness value of the sub-pixel to be calculated and a part of the theoretical brightness values of a plurality of auxiliary sub-pixels corresponding to the sub-pixel to be calculated, wherein:

the number of the auxiliary sub-pixels corresponding to the sub-pixel to be calculated is three. The color of each auxiliary sub-pixel is the same as the color of the sub-pixel to be calculated. The sub-pixel to be calculated and the three auxiliary sub-pixels corresponding thereto are located at four apexes of a kite (such as a rhombus), respectively; or the number of the auxiliary sub-pixels corresponding to the sub-pixel to be calculated is four. The color of each auxiliary sub-pixel is different from the color of the sub-pixel to be calculated. The four auxiliary sub-pixels are located at four apexes of a parallelogram (such as a square), respectively, and the sub-pixel to be calculated is located within the parallelogram.

3. A signal outputting unit, for outputting a signal to each sub-pixel so that the brightness value of each sub-pixel reaches the actual brightness value thereof which is obtained by the actual brightness value calculating unit.

The driving module of a pixel array is used for performing the driving method of a pixel array according to the present invention, so that a display effect of a higher visual resolution can be achieved by the display panel with a certain physical resolution.

As described above, when the number of the corresponding auxiliary sub-pixels is four, the four auxiliary sub-pixels are located at four apexes of a rectangle. The lateral edge of the rectangle is parallel to the rows of the pixel array, and the longitudinal edge of the rectangle is parallel to the columns of the pixel array. Of course, the rectangle may be a square.

The driving module of a pixel array according to the present invention is suitable for an OLED display panel or a liquid crystal display panel. When the driving module of a pixel array is used for a liquid crystal display panel in which each sub-pixel of the pixel array includes a pixel electrode and a common electrode, the driving module of a pixel array includes a pixel voltage providing unit which is used for supplying a grey scale voltage to the pixel electrode and a common voltage providing unit which is used for supplying a common voltage to the common electrode. Liquid crystal molecules are rotated by an electric field generated between the pixel electrode and the common electrode, so as to display.

The pixel array includes a plurality of polarity periods. Each polarity period comprises at least two consecutive rows of sub-pixels having the same polarity distribution and at least one row of sub-pixels having a polarity distribution opposite to the polarity distribution of the two consecutive rows of sub-pixels having the same polarity distribution. And in each row, the polarity of a sub-pixel is opposite to the polarity of its adjacent pixels.

As described above, as an implementation of the present invention, the polarity period may comprise nine rows of sub-pixels.

In a polarity period, the polarity distribution of the sub-pixels in the first row is the same as the polarity distribution of the sub-pixels in the fourth and fifth rows, and is opposite to the polarity distribution of the sub-pixels in the other rows.

Optionally, in a polarity period, the polarity distribution of the sub-pixels in the first row is the same as the polarity distribution of the sub-pixels in the fourth row, and is opposite to the polarity distribution of the sub-pixels in the other rows.

Optionally, in a polarity period, the polarity distribution of the sub-pixels in the first row is the same as the polarity distribution of the sub-pixels in the fourth to sixth rows, and is opposite to the polarity distribution of the sub-pixels in the other rows.

Optionally, in a polarity period, the polarity distribution of the sub-pixels in the first row is the same as the polarity distribution of the sub-pixels in the fourth to seventh rows, and is opposite to the polarity distribution of the sub-pixels in the other rows.

Optionally, in a polarity period, the polarity distribution of the sub-pixels in the first row is the same as the polarity distribution of the sub-pixels in the third to fifth rows, and is opposite to the polarity distribution of the sub-pixels in the other rows.

Optionally, in a polarity period, the polarity distribution of the sub-pixels in the first row is the same as the polarity distribution of the sub-pixels in the third to sixth rows, and is opposite to the polarity distribution of the sub-pixels in the other rows.

Optionally, in a polarity period, the polarity distribution of the sub-pixels in the first row is the same as the polarity distribution of the sub-pixels in the third to seventh rows, and is opposite to the polarity distribution of the sub-pixels in the other rows.

Optionally, in a polarity period, the polarity distribution of the sub-pixels in the first row is the same as the polarity distribution of the sub-pixels in the third to eighth rows, and is opposite to the polarity distribution of the sub-pixels in the other rows.

As described above, in the present invention, in each repeating unit:

the sub-pixels in the first row are in sequence of a blue sub-pixel B, a green sub-pixel G, a sub-pixel X and a red sub-pixel R, and the sub-pixels in the second row are in sequence of a sub-pixel X, a red sub-pixel R, a blue sub-pixel B and a green sub-pixel G; or the sub-pixels in the first row are in sequence of a blue sub-pixel B, a green sub-pixel G, a red sub-pixel R and a sub-pixel X, and the sub-pixels in the second row are in sequence of a sub-pixel X, a red sub-pixel R, a blue sub-pixel B and a green sub-pixel G; or the sub-pixels in the first row are in sequence of a blue sub-pixel B, a red sub-pixel R, a sub-pixel X and a green sub-pixel G, and the sub-pixels in the second row are in sequence of a sub-pixel X, a green sub-pixel G, a red sub-pixel R and a blue sub-pixel B; or the sub-pixels in the first row are in sequence of a blue sub-pixel B, a red sub-pixel R, a sub-pixel X and a green sub-pixel G, and the sub-pixels in the second row are in sequence of a green sub-pixel G, a sub-pixel X, a blue sub-pixel B and a red sub-pixel R; or the sub-pixels in the first row are in sequence of a green sub-pixel G, a blue sub-pixel B, a sub-pixel X and a red sub-pixel R, and the sub-pixels in the second row are in sequence of a sub-pixel X, a red sub-pixel R, a green sub-pixel G and a blue sub-pixel B; or the sub-pixels in the first row are in sequence of a green sub-pixel G, a red sub-pixel R, a sub-pixel X and a blue sub-pixel B, and the sub-pixels in the second row are in sequence of a sub-pixel X, a blue sub-pixel B, a green sub-pixel G and a red sub-pixel R; or the sub-pixels in the first row are in sequence of a green sub-pixel G, a blue sub-pixel B, a red sub-pixel R and a sub-pixel X, and the sub-pixels in the second row are in sequence of a sub-pixel X, a red sub-pixel R, a green sub-pixel G and a blue sub-pixel B; or the sub-pixels in the first row are in sequence of a green sub-pixel G, a red sub-pixel R, a blue sub-pixel B and a sub-pixel X, and the sub-pixels in the second row are in sequence of a sub-pixel X, a blue sub-pixel B, a green sub-pixel G and a red sub-pixel R; or the sub-pixels in the first row are in sequence of a green sub-pixel G, a red sub-pixel R, a sub-pixel X and a blue sub-pixel B, and the sub-pixels in the second row are in sequence of a sub-pixel X, a blue sub-pixel B, a green sub-pixel G and a red sub-pixel R; or the sub-pixels in the first row are in sequence of a sub-pixel X, a blue sub-pixel B, a green sub-pixel G and a red sub-pixel R, and the sub-pixels in the second row are in sequence of a green sub-pixel G, a red sub-pixel R, a sub-pixel X and a blue sub-pixel B.

In still another aspect of the present invention, there is provided a display device including a pixel array and a driving module of a pixel array. The driving module of a pixel array, which is the driving module of a pixel array according to the present invention, is used for driving the pixel array. Wherein the pixel array includes a plurality of repeating units, and each repeating unit includes two rows of sub-pixels, each row of sub-pixels comprise four sub-pixels having different colors. In each repeating unit, the first two sub-pixels in the first row have the same colors as the last two sub-pixels in the second row, and the last two sub-pixels in the first row have the same colors as the first two sub-pixels in the second row.

The driving module of a pixel array is used for performing the driving method of a pixel array according to the present invention, so that a display effect of a higher visual resolution can be achieved by the display panel with a certain physical resolution.

It should be understood that, the above implementations are only exemplary embodiments for the purpose of explaining the principle of the present invention, and the present invention is not limited thereto. For a person skilled in the art, various improvements and modifications may be made to the present invention without departing from the spirit and essence of the present invention. These improvements and modifications are also deemed to be within the protection scope of the present invention.

What is claimed is:

1. A driving method of a pixel array, the pixel array includes a plurality of repeating units, each repeating unit includes two rows of sub-pixels, each row of sub-pixels comprise four sub-pixels having different colors, in each repeating unit, first two sub-pixels in a first row have the same colors as last two sub-pixels in a second row, and last two sub-pixels in the first row have the same colors as first two sub-pixels in the second row, wherein, the driving method includes:

step 1: obtaining a theoretical brightness value of each sub-pixel for an image to be displayed;

step 2: calculating an actual brightness value of each sub-pixel, the actual brightness value of a sub-pixel to be calculated is a sum of a part of the theoretical brightness value of the sub-pixel to be calculated and a part of the theoretical brightness values of a plurality of auxiliary sub-pixels corresponding to the sub-pixel to be calculated, wherein the number of the auxiliary sub-pixels corresponding to the sub-pixel to be calculated is three, the color of each auxiliary sub-pixel is the same as the color of the sub-pixel to be calculated, and the sub-pixel to be calculated and the three auxiliary sub-pixels corresponding thereto are located at four apexes of a kite respectively, or the number of the auxiliary sub-pixel corresponding to the sub-pixel to be calculated is four, the color of each auxiliary sub-pixel is different from the color of the sub-pixel to be calculated, and the four auxiliary sub-pixels are located at four apexes of a parallelogram and the sub-pixel to be calculated is located inside the parallelogram; and step 3: outputting a signal to each sub-pixel so that the brightness value of each sub-pixel reaches the actual brightness value thereof which is obtained in the step 2.

2. The driving method of a pixel array according to claim 1, wherein, when the number of the auxiliary sub-pixels is four, the parallelogram is a rectangle, the lateral edge of the rectangle is parallel to the rows of the pixel array and the longitudinal edge of the rectangle is parallel to the columns of the pixel array.

3. The driving method of a pixel array according to claim 2, wherein, in each repeating unit:

the sub-pixels in the first row are in sequence of a blue sub-pixel, a green sub-pixel, the other color sub-pixel and a red sub-pixel, and the sub-pixels in the second row are in sequence of the other color sub-pixel, a red sub-pixel, a blue sub-pixel and a green sub-pixel; or the sub-pixels in the first row are in sequence of a blue sub-pixel, a green sub-pixel, a red sub-pixel and the other color sub-pixel, and the sub-pixels in the second row are in sequence of the other color sub-pixel, a red sub-pixel, a blue sub-pixel and a green sub-pixel; or the sub-pixels in the first row are in sequence of a blue sub-pixel, a red sub-pixel, the other color sub-pixel and a green sub-pixel, and the sub-pixels in the second row are in sequence of the other color sub-pixel, a green sub-pixel, a red sub-pixel and a blue sub-pixel; or the sub-pixels in the first row are in sequence of a blue sub-pixel, a red sub-pixel, the other color sub-pixel and a green sub-pixel, and the sub-pixels in the second row are in sequence of a green sub-pixel, the other color sub-pixel, a blue sub-pixel and a red sub-pixel; or the sub-pixels in the first row are in sequence of a green sub-pixel, a blue sub-pixel, the other color sub-pixel and a red sub-pixel, and the sub-pixels in the second row are in sequence of the other color sub-pixel, a red sub-pixel, a green sub-pixel and a blue sub-pixel; or the sub-pixels in the first row are in sequence of a green sub-pixel, a red sub-pixel, the other color sub-pixel and a blue sub-pixel, and the sub-pixels in the second row are in sequence of the other color sub-pixel, a blue sub-pixel, a green sub-pixel and a red sub-pixel; or the sub-pixels in the first row are in sequence of a green sub-pixel, a blue sub-pixel, a red sub-pixel and the other color sub-pixel, and the sub-pixels in the second row are in sequence of the other color sub-pixel, a red sub-pixel, a green sub-pixel and a blue sub-pixel; or the sub-pixels in the first row are in sequence of a green sub-pixel, a red sub-pixel, a blue sub-pixel and the other color sub-pixel, and the sub-pixels in the second row are in sequence of the other color sub-pixel, a blue sub-pixel, a green sub-pixel and a red sub-pixel; or the sub-pixels in the first row are in sequence of a green sub-pixel, a red sub-pixel, the other color sub-pixel and a blue sub-pixel, and the sub-pixels in the second row are in sequence of the other color sub-pixel, a blue sub-pixel, a green sub-pixel and a red sub-pixel; or the sub-pixels in the first row are in sequence of the other color sub-pixel, a blue sub-pixel, a green sub-pixel and a red sub-pixel, and the sub-pixels in the second row are in sequence of a green sub-pixel, a red sub-pixel, the other color sub-pixel and a blue sub-pixel.

4. The driving method of a pixel array according to claim 3, wherein the other color sub-pixel is any one of a yellow sub-pixel, a white sub-pixel, a cyan sub-pixel and a magenta sub-pixel.

5. The driving method of a pixel array according to claim 1, wherein the pixel array includes a plurality of polarity periods, each polarity period comprises at least two consecutive rows of sub-pixels having the same polarity distribution and at least one row of sub-pixels having a polarity distribution opposite to the polarity distribution of the two consecutive rows of sub-pixels having the same polarity distribution, and in each row, the polarity of a sub-pixel is opposite to the polarity of its adjacent sub-pixel in the row.

6. The driving method of a pixel array according to claim 5, wherein one polarity period includes nine consecutive rows of sub-pixels, wherein:

the polarity distribution of the sub-pixels in a first row is the same as the polarity distribution of the sub-pixels in fourth and fifth rows, and is opposite to the polarity distribution of the sub-pixels in the other rows; or the polarity distribution of the sub-pixels in a first row is the same as the polarity distribution of the sub-pixels in a fourth row, and is opposite to the polarity distribution of the sub-pixels in the other rows; or the polarity distribution of the sub-pixels in a first row is the same as the polarity distribution of the sub-pixels in fourth to sixth rows, and is opposite to the polarity distribution of the sub-pixels in the other rows; or the polarity distribution of the sub-pixels in a first row is the same as the polarity distribution of the sub-pixels in fourth to seventh rows, and is opposite to the polarity distribution of the sub-pixels in the other rows; or the polarity distribution of the sub-pixels in a first row is the same as the polarity distribution of the sub-pixels in third to fifth rows, and is opposite to the polarity distribution of the sub-pixels in the other rows; or the polarity distribution of the sub-pixels in a first row is the same as the polarity distribution of the sub-pixels in third to sixth rows, and is opposite to the polarity distribution of the sub-pixels in the other rows; or the polarity distribution of the sub-pixels in a first row is the same as the polarity distribution of the sub-pixels in third to seventh rows, and is opposite to the polarity distribution of the sub-pixels in the other rows; or the polarity distribution of the sub-pixels in a first row is the same as the polarity distribution of the sub-pixels in third to eighth rows, and is opposite to the polarity distribution of the sub-pixels in the other rows.

7. The driving method of a pixel array according to claim 6, wherein, in each repeating unit:

the sub-pixels in the first row are in sequence of a blue sub-pixel, a green sub-pixel, the other color sub-pixel and a red sub-pixel, and the sub-pixels in the second row are in sequence of the other color sub-pixel, a red sub-pixel, a blue sub-pixel and a green sub-pixel; or the sub-pixels in the first row are in sequence of a blue sub-pixel, a green sub-pixel, a red sub-pixel and the other color sub-pixel, and the sub-pixels in the second row are in sequence of the other color sub-pixel, a red sub-pixel, a blue sub-pixel and a green sub-pixel; or the sub-pixels in the first row are in sequence of a blue sub-pixel, a red sub-pixel, the other color sub-pixel and a green sub-pixel, and the sub-pixels in the second row are in sequence of the other color sub-pixel, a green sub-pixel, a red sub-pixel and a blue sub-pixel; or the sub-pixels in the first row are in sequence of a blue sub-pixel, a red sub-pixel, the other color sub-pixel and a green sub-pixel, and the sub-pixels in the second row are in sequence of a green sub-pixel, the other color sub-pixel, a blue sub-pixel and a red sub-pixel; or the sub-pixels in the first row are in sequence of a green sub-pixel, a blue sub-pixel, the other color sub-pixel and a red sub-pixel, and the sub-pixels in the second row are in sequence of the other color sub-pixel, a red sub-pixel, a green sub-pixel and a blue sub-pixel; or the sub-pixels in the first row are in sequence of a green sub-pixel, a red sub-pixel, the other color sub-pixel and a blue sub-pixel, and the sub-pixels in the second row are in sequence of the other color sub-pixel, a blue sub-pixel, a green sub-pixel and a red sub-pixel; or the sub-pixels in the first row are in sequence of a green sub-pixel, a blue sub-pixel, a red sub-pixel and the other color sub-pixel, and the sub-pixels in the second row are in sequence of the other color sub-pixel, a red sub-pixel, a green sub-pixel and a blue sub-pixel; or the sub-pixels in the first row are in sequence of a green sub-pixel, a red sub-pixel, a blue sub-pixel and the other color sub-pixel, and the sub-pixels in the second row are in sequence of the other color sub-pixel, a blue sub-pixel, a green sub-pixel and a red sub-pixel; or the sub-pixels in the first row are in sequence of a green sub-pixel, a red sub-pixel, the other color sub-pixel and a blue sub-pixel, and the sub-pixels in the second row are in sequence of the other color sub-pixel, a blue sub-pixel, a green sub-pixel and a red sub-pixel; or the sub-pixels in the first row are in sequence of the other color sub-pixel, a blue sub-pixel, a green sub-pixel and a red sub-pixel, and the sub-pixels in the second row are in sequence of a green sub-pixel, a red sub-pixel, the other color sub-pixel and a blue sub-pixel.

8. The driving method of a pixel array according to claim 7, wherein the other color sub-pixel is any one of a yellow sub-pixel, a white sub-pixel, a cyan sub-pixel and a magenta sub-pixel.

9. The driving method of a pixel array according to claim 5, wherein, in each repeating unit:

the sub-pixels in the first row are in sequence of a blue sub-pixel, a green sub-pixel, the other color sub-pixel and a red sub-pixel, and the sub-pixels in the second row are in sequence of the other color sub-pixel, a red sub-pixel, a blue sub-pixel and a green sub-pixel; or the sub-pixels in the first row are in sequence of a blue sub-pixel, a green sub-pixel, a red sub-pixel and the other color sub-pixel, and the sub-pixels in the second row are in sequence of the other color sub-pixel, a red sub-pixel, a blue sub-pixel and a green sub-pixel; or the sub-pixels in the first row are in sequence of a blue sub-pixel, a red sub-pixel, the other color sub-pixel and a green sub-pixel, and the sub-pixels in the second row are in sequence of the other color sub-pixel, a green sub-pixel, a red sub-pixel and a blue sub-pixel; or the sub-pixels in the first row are in sequence of a blue sub-pixel, a red sub-pixel, the other color sub-pixel and a green sub-pixel, and the sub-pixels in the second row are in sequence of a green sub-pixel, the other color sub-pixel, a blue sub-pixel and a red sub-pixel; or the sub-pixels in the first row are in sequence of a green sub-pixel, a blue sub-pixel, the other color sub-pixel and a red sub-pixel, and the sub-pixels in the second row are in sequence of the other color sub-pixel, a red sub-pixel, a green sub-pixel and a blue sub-pixel; or the sub-pixels in the first row are in sequence of a green sub-pixel, a red sub-pixel, the other color sub-pixel and a blue sub-pixel, and the sub-pixels in the second row are in sequence of the other color sub-pixel, a blue sub-pixel, a green sub-pixel and a red sub-pixel; or the sub-pixels in the first row are in sequence of a green sub-pixel, a blue sub-pixel, a red sub-pixel and the other color sub-pixel, and the sub-pixels in the second row are in sequence of the other color sub-pixel, a red sub-pixel, a green sub-pixel and a blue sub-pixel; or the sub-pixels in the first row are in sequence of a green sub-pixel, a red sub-pixel, a blue sub-pixel and the other color sub-pixel, and the sub-pixels in the second row are in sequence of the other color sub-pixel, a blue sub-pixel, a green sub-pixel and a red sub-pixel; or the sub-pixels in the first row are in sequence of a green sub-pixel, a red sub-pixel, the other color sub-pixel and a blue sub-pixel, and the sub-pixels in the second row are in sequence of the other color sub-pixel, a blue sub-pixel, a green sub-pixel and a red sub-pixel; or the sub-pixels in the first row are in sequence of the other color sub-pixel, a blue sub-pixel, a green sub-pixel and a red sub-pixel, and the sub-pixels in the second row are in sequence of a green sub-pixel, a red sub-pixel, the other color sub-pixel and a blue sub-pixel.

10. The driving method of a pixel array according to claim 9, wherein the other color sub-pixel is any one of a yellow sub-pixel, a white sub-pixel, a cyan sub-pixel and a magenta sub-pixel.

11. The driving method of a pixel array according to claim 1, wherein, in each repeating unit:

the sub-pixels in the first row are in sequence of a blue sub-pixel, a green sub-pixel, the other color sub-pixel and a red sub-pixel, and the sub-pixels in the second row are in sequence of the other color sub-pixel, a red sub-pixel, a blue sub-pixel and a green sub-pixel; or the sub-pixels in the first row are in sequence of a blue sub-pixel, a green sub-pixel, a red sub-pixel and the other color sub-pixel, and the sub-pixels in the second row are in sequence of the other color sub-pixel, a red sub-pixel, a blue sub-pixel and a green sub-pixel; or the sub-pixels in the first row are in sequence of a blue sub-pixel, a red sub-pixel, the other color sub-pixel and a green sub-pixel, and the sub-pixels in the second row are in sequence of the other color sub-pixel, a green sub-pixel, a red sub-pixel and a blue sub-pixel; or the sub-pixels in the first row are in sequence of a blue sub-pixel, a red sub-pixel, the other color sub-pixel and a green sub-pixel, and the sub-pixels in the second row are in sequence of a green sub-pixel, the other color sub-pixel, a blue sub-pixel and a red sub-pixel; or the sub-pixels in the first row are in sequence of a green sub-pixel, a blue sub-pixel, the other color sub-pixel and a red sub-pixel, and the sub-pixels in the second row are in sequence of the other color sub-pixel, a red sub-pixel, a green sub-pixel and a blue sub-pixel; or the sub-pixels in the first row are in sequence of a green sub-pixel, a blue sub-pixel, the other color sub-pixel and a red sub-pixel, and the sub-pixels in the second row are in sequence of the other color sub-pixel, a red sub-pixel, a green sub-pixel and a blue sub-pixel; or the sub-pixels in the first row are in sequence of a green sub-pixel, a red sub-pixel, the other color sub-pixel and a blue sub-pixel, and the sub-pixels in the second row are in sequence of the other color sub-pixel, a blue sub-pixel, a green sub-pixel and a red sub-pixel; or the sub-pixels in the first row are in sequence of a green sub-pixel, a blue sub-pixel, a red sub-pixel and the other color sub-pixel, and the sub-pixels in the second row are in sequence of the other color sub-pixel, a red sub-pixel, a green sub-pixel and a blue sub-pixel; or the sub-pixels in the first row are in sequence of a green sub-pixel, a red sub-pixel, a blue sub-pixel and the other color sub-pixel, and the sub-pixels in the second row are in sequence of the other color sub-pixel, a blue sub-pixel, a green sub-pixel and a red sub-pixel; or the sub-pixels in the first row are in sequence of a green sub-pixel, a red sub-pixel, the other color sub-pixel and a blue sub-pixel, and the sub-pixels in the second row are in sequence of the other color sub-pixel, a blue sub-pixel, a green sub-pixel and a red sub-pixel; or the sub-pixels in the first row are in sequence of the other color sub-pixel, a blue sub-pixel, a green sub-pixel and a red sub-pixel, and the sub-pixels in the second row are in sequence of a green sub-pixel, a red sub-pixel, the other color sub-pixel and a blue sub-pixel.

12. The driving method of a pixel array according to claim 11, wherein the other color sub-pixel is any one of a yellow sub-pixel, a white sub-pixel, a cyan sub-pixel and a magenta sub-pixel.

13. A driving module of a pixel array, the pixel array includes a plurality of repeating units, each repeating unit includes two rows of sub-pixels, each row of sub-pixels comprise four sub-pixels having different colors, in each repeating unit, first two sub-pixels in a first row have the same colors as last two sub-pixels in a second row, and last two sub-pixels in the first row have the same colors as first two sub-pixels in the second row, the driving module of a pixel array includes:

a theoretical brightness value obtaining unit, for obtaining a theoretical brightness value of each sub-pixel for an image to be displayed;

an actual brightness value calculating unit, for calculating an actual brightness value of each sub-pixel, the actual brightness value of a sub-pixel to be calculated is a sum of a part of the theoretical brightness value of the sub-pixel to be calculated and a part of the theoretical brightness values of a plurality of auxiliary sub-pixels corresponding to the sub-pixel to be calculated, wherein the number of the auxiliary sub-pixels corresponding to the sub-pixel to be calculated is three, the color of each auxiliary sub-pixel is the same as the color of the sub-pixel to be calculated, and the sub-pixel to be calculated and the three auxiliary sub-pixels corresponding thereto are located at four apexes of a kite, respectively, or the number of the auxiliary sub-pixels corresponding to the sub-pixel to be calculated is four, the color of each auxiliary sub-pixel is different from the color of the sub-pixel to be calculated, the four auxiliary sub-pixels are located at four apexes of a parallelogram, respectively, and the sub-pixel to be calculated is located within the parallelogram; and a signal outputting unit, for outputting a signal to each sub-pixel so that the brightness value of each sub-pixel reaches the actual brightness value thereof which is obtained by the actual brightness value calculating unit.

14. The driving module of a pixel array according to claim 13, wherein, when the number of the auxiliary sub-pixels is four, the parallelogram is a rectangle, and the lateral edge of the rectangle is parallel to the rows of the pixel array and the longitudinal edge of the rectangle is parallel to the columns of the pixel array.

15. The driving module of a pixel array according to claim 13, wherein the pixel array includes a plurality of polarity periods, each polarity period comprises at least two consecutive rows of sub-pixels having the same polarity distribution and at least one row of sub-pixels having a polarity distribution opposite to the polarity distribution of the two consecutive rows of sub-pixels having the same polarity distribution, and in each row, the polarity of a sub-pixel is opposite to the polarity of its adjacent sub-pixel in the row.

16. The driving module of a pixel array according to claim 15, wherein one polarity period includes nine consecutive rows of sub-pixels, wherein:

the polarity distribution of the sub-pixels in a first row is the same as the polarity distribution of the sub-pixels in fourth and fifth rows, and is opposite to the polarity distribution of the sub-pixels in the other rows; or the polarity distribution of the sub-pixels in a first row is the same as the polarity distribution of the sub-pixels in a fourth row, and is opposite to the polarity distribution of the sub-pixels in the other rows; or the polarity distribution of the sub-pixels in a first row is the same as the polarity distribution of the sub-pixels in fourth to sixth rows, and is opposite to the polarity distribution of the sub-pixels in the other rows; or the polarity distribution of the sub-pixels in a first row is the same as the polarity distribution of the sub-pixels in fourth to seventh rows, and is opposite to the polarity distribution of the sub-pixels in the other rows; or the polarity distribution of the sub-pixels in a first row is the same as the polarity distribution of the sub-pixels in third to fifth rows, and is opposite to the polarity distribution of the sub-pixels in the other rows; or the polarity distribution of the sub-pixels in a first row is the same as the polarity distribution of the sub-pixels in third to sixth rows, and is opposite to the polarity distribution of the sub-pixels in the other rows; or the polarity distribution of the sub-pixels in a first row is the same as the polarity distribution of the sub-pixels in third to seventh rows, and is opposite to the polarity distribution of the sub-pixels in the other rows; or the polarity distribution of the sub-pixels in a first row is the same as the polarity distribution of the sub-pixels in third to eighth rows, and is opposite to the polarity distribution of the sub-pixels in the other rows.

17. The driving module of a pixel array according to claim 13, wherein, in each repeating unit:

the sub-pixels in the first row are in sequence of a blue sub-pixel, a green sub-pixel, the other color sub-pixel and a red sub-pixel, and the sub-pixels in the second row are in sequence of the other color sub-pixel, a red sub-pixel, a blue sub-pixel and a green sub-pixel; or the sub-pixels in the first row are in sequence of a blue sub-pixel, a green sub-pixel, a red sub-pixel and the other color sub-pixel, and the sub-pixels in the second row are in sequence of the other color sub-pixel, a red sub-pixel, a blue sub-pixel and a green sub-pixel; or the sub-pixels in the first row are in sequence of a blue sub-pixel, a red sub-pixel, the other color sub-pixel and a green sub-pixel, and the sub-pixels in the second row are in sequence of the other color sub-pixel, a green sub-pixel, a red sub-pixel and a blue sub-pixel; or the sub-pixels in the first row are in sequence of a blue sub-pixel, a red sub-pixel, the other color sub-pixel and a green sub-pixel, and the sub-pixels in the second row are in sequence of a green sub-pixel, the other color sub-pixel, a blue sub-pixel and a red sub-pixel; or the sub-pixels in the first row are in sequence of a green sub-pixel, a blue sub-pixel, the other color sub-pixel and a red sub-pixel, and the sub-pixels in the second row are in sequence of the other color sub-pixel, a red sub-pixel, a green sub-pixel and a blue sub-pixel; or the sub-pixels in the first row are in sequence of a green sub-pixel, a red sub-pixel, the other color sub-pixel and a blue sub-pixel, and the sub-pixels in the second row are in sequence of the other color sub-pixel, a blue sub-pixel, a green sub-pixel and a red sub-pixel; or the sub-pixels in the first row are in sequence of a green sub-pixel, a blue sub-pixel, a red sub-pixel and the other color sub-pixel, and the sub-pixels in the second row are in sequence of the other color sub-pixel, a red sub-pixel, a green sub-pixel and a blue sub-pixel; or the sub-pixels in the first row are in sequence of a green sub-pixel, a red sub-pixel, a blue sub-pixel and the other color sub-pixel, and the sub-pixels in the second row are in sequence of the other color sub-pixel, a blue sub-pixel, a green sub-pixel and a red sub-pixel; or the sub-pixels in the first row are in sequence of a green sub-pixel, a red sub-pixel, the other color sub-pixel and a blue sub-pixel, and the sub-pixels in the second row are in sequence of the other color sub-pixel, a blue sub-pixel, a green sub-pixel and a red sub-pixel; or the sub-pixels in the first row are in sequence of the other color sub-pixel, a blue sub-pixel, a green sub-pixel and a red sub-pixel, and the sub-pixels in the second row are in sequence of a green sub-pixel, a red sub-pixel, the other color sub-pixel and a blue sub-pixel.

18. The driving module of a pixel array according to claim 17, wherein the other color sub-pixel is any one of a yellow sub-pixel, a white sub-pixel, a cyan sub-pixel and a magenta sub-pixel.

19. A display device, including a pixel array and a driving module of a pixel array, the driving module of a pixel array is used for driving the pixel array, wherein:

the pixel array includes a plurality of repeating units, each repeating unit includes two rows of sub-pixels, each row of sub-pixels comprise four sub-pixels having different colors, in each repeating unit, first two sub-pixels in a first row have the same colors as last two sub-pixels in a second row, and last two sub-pixels in the first row have the same colors as first two sub-pixels in the second row; and the driving module of a pixel array includes:

a theoretical brightness value obtaining unit, for obtaining a theoretical brightness value of each sub-pixel for an image to be displayed;

an actual brightness value calculating unit, for calculating an actual brightness value of each sub-pixel, the actual brightness value of a sub-pixel to be calculated is a sum of a part of the theoretical brightness value of the sub-pixel to be calculated and a part of the theoretical brightness values of a plurality of auxiliary sub-pixels corresponding to the sub-pixel to be calculated, wherein the number of the auxiliary sub-pixels corresponding to the sub-pixel to be calculated is three, the color of each auxiliary sub-pixel is the same as the color of the sub-pixel to be calculated, the sub-pixel to be calculated and these three auxiliary sub-pixels corresponding thereto are located at four apexes of a kite, respectively, or the number of the auxiliary sub-pixels corresponding to the sub-pixel to be calculated is four, the color of each auxiliary sub-pixel is different from the color of the sub-pixel to be calculated, the four auxiliary sub-pixels are located at four apexes of a parallelogram, respectively, and the sub-pixel to be calculated is located within the parallelogram; and a signal outputting unit, for outputting a signal to each sub-pixel so that the brightness value of each sub-pixel reaches the actual brightness value thereof which is obtained by the actual brightness value calculating unit.

20. The display device according to claim 19, wherein, when the number of the auxiliary sub-pixels is four, the parallelogram is a rectangle, the lateral edge of the rectangle is parallel to the rows of the pixel array and the longitudinal edge of the rectangle is parallel to the columns of the pixel array.

* * * * *